US012167808B2

(12) United States Patent
Bullock et al.

(10) Patent No.: US 12,167,808 B2
(45) **Date of Patent: *Dec. 17, 2024**

(54) LID ASSEMBLY FOR A BEVERAGE CONTAINER

(71) Applicant: YETI Coolers, LLC, Austin, TX (US)

(72) Inventors: Dustin R. Bullock, Austin, TX (US); Nicholas James Lombardi, Austin, TX (US); William Drinkwater, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/209,237

(22) Filed: Jun. 13, 2023

(65) Prior Publication Data

US 2023/0397746 A1 Dec. 14, 2023

Related U.S. Application Data

(63) Continuation of application No. 17/569,791, filed on Jan. 6, 2022, now Pat. No. 11,712,124.
(Continued)

(51) Int. Cl.
*A47G 19/22* (2006.01)
*B65D 43/02* (2006.01)
(Continued)

(52) U.S. Cl.
CPC ..... *A47G 19/2272* (2013.01); *B65D 43/022* (2013.01); *B65D 51/1611* (2013.01);
(Continued)

(58) Field of Classification Search
CPC ..... A47G 19/2272; A47G 19/2222; A47G 19/2266; B65D 43/022; B65D 51/1611;
(Continued)

(56) References Cited

U.S. PATENT DOCUMENTS 3,044,650 A 7/1962 Oltion et al.
3,173,566 A 3/1965 Talbert
(Continued)

FOREIGN PATENT DOCUMENTS

AT 509897 B1 * 7/2012 ..... B65D 47/061
CN 202179387 U 4/2012
(Continued)

OTHER PUBLICATIONS

May 31, 2022—(WO) International Search Report and Written Opinion—PCT/US2022/011403.
Jun. 12, 2024—(AU) Examination Report 1—App. No. 2022205619.

*Primary Examiner* — Don M Anderson
*Assistant Examiner* — Eric C Baldrighi
(74) *Attorney, Agent, or Firm* — Banner & Witcoff, Ltd.

(57) ABSTRACT

A leak resistant lid assembly for a beverage container where the lid assembly has a straw or similar means for a user to drink liquid is disclosed. The lid assembly may include a base, a straw that extends through the base, a gasket, and a grommet. The base may have a primary opening that receives the straw and a secondary opening in the top of the base, where the secondary opening acts as a vent to prevent a vacuum from occurring when drinking from a straw. The grommet may have a spiral ring may help create a flow path for air from inside the beverage container to the exterior environment.

17 Claims, 11 Drawing Sheets

Related U.S. Application Data

(60) Provisional application No. 63/135,378, filed on Jan. 8, 2021.

(51) Int. Cl.
*B65D 51/16* (2006.01)
*B65D 53/02* (2006.01)

(52) U.S. Cl.
CPC .... *B65D 53/02* (2013.01); *B65D 2543/00046* (2013.01); *B65D 2543/00092* (2013.01); *B65D 2543/0049* (2013.01); *B65D 2543/00546* (2013.01); *B65D 2543/00972* (2013.01)

(58) Field of Classification Search
CPC ..... B65D 53/02; B65D 2543/00046; B65D 2543/00092; B65D 2543/0049; B65D 2543/00546; B65D 2543/00972; B65D 47/32
USPC ..... 220/709
See application file for complete search history.

(56) References Cited

U.S. PATENT DOCUMENTS 4,441,640 A 4/1984 Lottick
4,485,963 A 12/1984 Panicci
4,714,173 A 12/1987 Ruiz
4,966,300 A 10/1990 Coonradt
4,976,364 A 12/1990 Solomon
5,021,019 A 6/1991 Gandy
5,085,335 A 2/1992 Carbaugh
5,105,975 A 4/1992 Patterson
5,234,117 A 8/1993 Garvin
5,307,950 A 5/1994 Li
5,361,934 A 11/1994 Spence, Jr.
5,381,924 A 1/1995 Kiefel
5,395,322 A 3/1995 Moser et al.
5,462,194 A 10/1995 Barnwell
5,509,551 A 4/1996 Terrell, II
5,513,762 A 5/1996 Janani
5,560,513 A 10/1996 Jarrell
5,598,945 A 2/1997 Gracy
5,662,268 A 9/1997 Katzenberger
5,893,472 A 4/1999 Forrer
5,897,013 A 4/1999 Manganiello
5,938,053 A 8/1999 Verbovszky et al.
6,116,458 A 9/2000 Dark
6,230,923 B1 5/2001 Hung
6,305,570 B1 10/2001 Atkin et al.
6,375,019 B1 4/2002 Hirota et al.
6,427,928 B1 8/2002 Hirota et al.
6,523,711 B1 2/2003 Hughes et al.
6,745,949 B2 6/2004 Lee
6,915,961 B2 7/2005 Renz et al.
6,929,135 B1 8/2005 Hajianpour
7,011,255 B2 3/2006 Zuccaro
7,044,316 B1 5/2006 Hsu
7,097,065 B2 8/2006 Yoneoka et al.
D527,566 S 9/2006 Mather et al.
7,100,838 B1 9/2006 Epstein
7,124,907 B2 10/2006 Conaway
7,350,666 B2 4/2008 Essebaggers
7,374,061 B2 5/2008 Næsje
7,516,862 B2 4/2009 McDonough
7,533,783 B2 5/2009 Choi et al.
7,798,360 B2 9/2010 Roberts
7,934,620 B2 5/2011 Stribling et al.
8,127,789 B2 3/2012 Schafer et al.
8,186,537 B2 5/2012 Rosnak et al.
8,313,644 B2 11/2012 Harris et al.
8,328,113 B2 12/2012 Stribling et al.
8,376,165 B2 2/2013 Chiang
8,376,246 B2 2/2013 White et al.
8,403,164 B2 3/2013 Samson
8,408,410 B2 4/2013 Raman
8,579,148 B2 11/2013 Slansky
8,608,016 B2 12/2013 Chiu et al.
8,622,236 B2 1/2014 Sanbrook et al.
8,733,582 B2 5/2014 Fioritto et al.
8,844,742 B2 9/2014 Fujita et al.
8,851,324 B2 10/2014 O'Sullivan
8,931,634 B2 1/2015 Anderson
D731,240 S 6/2015 Bell et al.
9,167,928 B2 10/2015 Hanners
9,346,607 B2 5/2016 Madjar
9,364,108 B2 6/2016 Chasin
9,526,363 B2 12/2016 Jorge
9,585,803 B2 3/2017 Niedens
9,624,006 B2 4/2017 Savino
9,694,953 B2 7/2017 Meyers et al.
9,932,155 B2 4/2018 Hobeich
9,994,459 B2 6/2018 Kellam et al.
10,080,453 B2 9/2018 Stewart
10,188,231 B2 1/2019 Hung
10,307,004 B1 6/2019 Lilley
10,420,433 B2 9/2019 Coon et al.
10,433,665 B2 10/2019 Zhang et al.
D873,603 S 1/2020 Diener et al.
11,712,124 B2 * 8/2023 Bullock ..... B65D 53/02 220/709
2001/0008241 A1 7/2001 Porter
2002/0145000 A1 10/2002 Li
2003/0218076 A1 11/2003 Farnsworth et al.
2004/0089629 A1 5/2004 Villaescusa et al.
2005/0061822 A1 3/2005 Naesje
2005/0105831 A1 5/2005 Weber et al.
2005/0121405 A1 6/2005 Drajan
2005/0167438 A1 8/2005 Minyayev
2006/0054629 A1 3/2006 Ronn et al.
2006/0102636 A1 5/2006 Clifton et al.
2006/0169792 A1 8/2006 Siri
2006/0201902 A1 9/2006 Brown et al.
2006/0255170 A1 11/2006 Kim
2007/0175908 A1 8/2007 Siri
2008/0149651 A1 * 6/2008 Samson ..... B65D 47/06 220/717
2008/0173610 A1 7/2008 Esposito
2008/0223818 A1 9/2008 Shafik
2008/0237247 A1 10/2008 Mucci et al.
2009/0039093 A1 2/2009 Forsythe et al.
2009/0200260 A1 8/2009 Durbin
2010/0092309 A1 4/2010 Hockemeier
2011/0011819 A1 1/2011 Lee
2013/0026196 A1 1/2013 Essebaggers et al.
2013/0126527 A1 5/2013 Chiu et al.
2013/0221004 A1 8/2013 Rosen
2013/0231026 A1 9/2013 Keungmanivong
2013/0327738 A1 12/2013 Harrison
2014/0069944 A1 3/2014 Shapiro et al.
2015/0076104 A1 3/2015 Sleebos
2015/0307265 A1 10/2015 Winn et al.
2016/0060002 A1 3/2016 Karotko
2016/0083154 A1 3/2016 Kim
2016/0100703 A1 4/2016 Fenner
2016/0174741 A1 6/2016 Scarbrough
2017/0066567 A1 * 3/2017 Chen ..... B65D 47/06
2017/0354279 A1 12/2017 Lohn et al.
2019/0000719 A1 1/2019 Nolimal
2019/0183269 A1 6/2019 Kalisz et al.
2019/0254451 A1 8/2019 Zonnenberg et al.
2019/0269228 A1 9/2019 Czerwinski et al.
2020/0339314 A1 10/2020 Meyers

FOREIGN PATENT DOCUMENTS

CN 202408290 U 9/2012
CN 202457659 U 10/2012
CN 203662460 U 6/2014
CN 104116383 A 10/2014
CN 203860946 U 10/2014
CN 104586202 A 5/2015
CN 104909056 A 9/2015
CN 104970978 A 10/2015

(56) References Cited

FOREIGN PATENT DOCUMENTS

| | | | |
|---|---|---|---|
| CN | 104983580 | A | 10/2015 |
| CN | 205083187 | U | 3/2016 |
| CN | 106108557 | A | 11/2016 |
| CN | 106913159 | A | 7/2017 |
| CN | 107616658 | A | 1/2018 |
| CN | 108652374 | A | 10/2018 |
| CN | 109288359 | A | 2/2019 |
| CN | 208709229 | U | 4/2019 |
| CN | 209152975 | U | 7/2019 |
| CN | 110123104 | A | 8/2019 |
| DE | 438087 | C | 12/1926 |
| DE | 9305352 | U1 | 8/1993 |
| EP | 1286900 | A2 | 3/2003 |
| EP | 1550618 | A1 | 7/2005 |
| EP | 2476628 | A1 | 7/2012 |
| EP | 3056448 | A1 | 8/2016 |
| GB | 2330136 | A | 4/1999 |
| GB | 2389510 | A | 12/2003 |
| GB | 2416765 | A | 2/2006 |
| GB | 2443053 | A | 4/2008 |
| JP | 2001114277 | A | 4/2001 |
| JP | 3208048 | B2 | 9/2001 |
| JP | 5009462 | B2 | 8/2012 |
| JP | 2015223363 | A | 12/2015 |
| JP | 6548132 | B1 | 7/2019 |
| KR | 20020075353 | A | 10/2002 |
| KR | 100659600 | B1 | 12/2006 |
| KR | 20120060391 | A | 6/2012 |
| KR | 20130015650 | A | 2/2013 |
| KR | 101485082 | B1 | 1/2015 |
| KR | 101485171 | B1 | 1/2015 |
| KR | 200476872 | Y1 | 4/2015 |
| KR | 200478541 | Y1 | 10/2015 |
| KR | 200480691 | Y1 | 6/2016 |
| KR | 101877555 | B1 | 7/2018 |
| KR | 101932346 | B1 | 12/2018 |
| KR | 20190023039 | A | 3/2019 |
| NL | 2003493 | C2 | 3/2011 |
| WO | 0049920 | A2 | 8/2000 |
| WO | 0075020 | A2 | 12/2000 |
| WO | 14116104 | A1 | 7/2014 |
| WO | 15155592 | A1 | 10/2015 |
| WO | 17113449 | A1 | 7/2017 |
| WO | 19102209 | | 5/2019 |

* cited by examiner

LID ASSEMBLY FOR A BEVERAGE CONTAINER

CROSS-REFERENCE TO RELATED APPLICATIONS

This application is a continuation of U.S. patent application Ser. No. 17/569,791, filed Jan. 6, 2022, which claims priority to U.S. Provisional Patent Application No. 63/135,378 filed on Jan. 8, 2021, all of which are herein incorporated by reference in their entirety.

FIELD

The present disclosure herein relates broadly to lids for drinkware, and more specifically to leak resistant lids for drinkware containers that provide a means for drinking.

BACKGROUND

Beverage containers can be filled with hot or cold drinkable liquids, such as water, coffee, tea, soft drink, or alcoholic beverage, such as beer. These beverage containers can be made of a variety of materials such as stainless steel, glass, plastic, cardboard, or paper material. Lids may be provided on beverage containers to provide a means for drinking the contents of the beverage container while also being resistant to leaks if spilled.

BRIEF SUMMARY

This Summary provides an introduction to some general concepts relating to this disclosure in a simplified form that are further described below in the Detailed Description. This Summary is not intended to identify key features or essential features of the disclosure.

Aspects of the disclosure herein may relate to a lid assembly for a beverage container, where the lid assembly comprises: a base including: (a) a cover member; (b) a lip extending upward from the cover member; the lip positioned around a perimeter of the cover member; (c) a skirt member extending downward from the cover member; (d) a retaining wall spaced inward from the skirt member creating a grommet groove between the skirt member and the retaining wall; (e) a primary opening in the cover member; and (f) a secondary opening spaced from the primary opening. The lid assembly further including a straw extending through the primary opening; and a grommet arranged in the grommet groove. The grommet may include a primary body member and a spiral ring extending outward from an outer surface of the primary body member, where the spiral ring creates an airflow path from below the lid assembly to the secondary opening. The spiral ring may contact an inboard surface of the skirt member, where an outboard edge of the spiral ring compresses against the inboard surface of the skirt member. The primary opening may be larger than the secondary opening. The lid assembly may also include a gasket arranged in a gasket groove in the skirt member, where the gasket includes a body member and an annular ring extending outward from an outer surface of the body member, and where the annular ring contacts an inner surface of the beverage container. The grommet may also comprise a secondary body member extending inward from the primary body member, and a straw opening in the secondary body member, where the straw extends through the straw opening. The grommet may further comprise a connecting member that extends from the primary body member to the secondary body member, where the connecting member extends around a lower end of the retaining wall. In addition, the grommet may be formed as a unitary member. In some examples, the spiral ring may extend at least 180 degrees around a perimeter of the primary body member, while in other examples, the spiral ring may extend at least 540 degrees around a perimeter of the primary body member. Also, the grommet may further comprise a pull tab to allow easy removal and cleaning.

Other aspects of this disclosure may relate to a lid assembly for a beverage container, where the lid assembly comprises: a base including: (a) a cover member; (b) a lip extending upward from the cover member; the lip positioned around a perimeter of the cover member; (c) a skirt member extending downward from the cover member; and (d) an opening in the cover member. The lid assembly may also include a straw extending through the opening and a gasket arranged in a gasket groove in the skirt member. The gasket may include a body member and a spiral ring extending outward from an outer surface of the body member, where the spiral ring creates an airflow path from below the lid assembly to an exterior of the lid assembly. An outboard edge of the spiral ring may be configured to contact an interior surface of the beverage container. In some examples, the spiral ring may extend at least 180 degrees around a perimeter of the body member, while in other examples, the spiral ring may extend at least 540 degrees around a perimeter of the body member. The lid assembly may further comprise a grommet arranged in the opening of the cover member, where the grommet includes a straw opening that receives the straw.

Additional aspects of this disclosure may relate to a lid assembly for a beverage container, where the lid assembly comprises: a base including: (a) a cover member; (b) a lip extending upward from the cover member; the lip positioned around a perimeter of the cover member; (c) a skirt member extending downward from the cover member; and (d) an opening in the cover member. The lid assembly may also include a straw extending through the opening and a gasket arranged in a gasket groove in the skirt member. The gasket may include a body member and a plurality of annular rings that extend outward from an outer surface of the body member, where each annular ring of the plurality of annular rings may have a gap, where the plurality of annular rings create an airflow path from below the lid assembly to an exterior of the lid assembly. A first gap on a first annular ring may be located at a different location on a first perimeter of the first annular ring than a second gap located on a second perimeter of a second annular ring. A grommet may be arranged in the opening of the cover member, where the grommet includes a straw opening that receives the straw.

Still other aspects of this disclosure may relate to a lid assembly for a beverage container, where the lid assembly comprises: a base including: (a) a cover member; (b) a lip extending upward from the cover member; the lip positioned around a perimeter of the cover member; (c) a skirt member extending downward from the cover member; (d) a retaining wall spaced inward from the skirt member creating a grommet groove between the skirt member and the retaining wall; (e) a primary opening in the cover member; and (f) a secondary opening spaced from the primary opening. The lid assembly may also include a straw extending through the primary opening and a grommet arranged in the grommet groove. The grommet may include a primary body member, a plurality of annular rings extending outward from an outer surface of the primary body member, where each annular ring of the plurality of annular rings has a gap such that the plurality of annular rings create an airflow path from below the lid assembly to the secondary opening. A first gap on a first annular ring is located at a different location on a first perimeter of the first annular ring than a second gap located on a second perimeter of a second annular ring. The grommet may include a secondary body member extending inward from the primary body member and a straw opening in the secondary body member, where the straw extends through the straw opening. The lid assembly may also include a gasket arranged in a gasket groove in the skirt member, where the gasket includes a body member and an annular ring extending outward from an outer surface of the body member.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "front," "top," "base," "bottom," "side," and "rear" and the like may be used in this specification to describe various example features and elements, these terms are used herein as a matter of convenience, e.g., based on the example orientations shown in the figures and/or the orientations in typical use. Additionally, the term "plurality," as used herein, indicates any number greater than one, either disjunctively or conjunctively, as necessary, up to an infinite number. Nothing in this specification should be construed as requiring a specific three dimensional or spatial orientation of structures in order to fall within the scope of the claims.

In general, this disclosure may relate to a leak resistant lid assembly with a straw or similar means where a user can drink liquid from a lid with an opening in the top. When drinking from a straw, air must travel into the container to prevent a vacuum from occurring. This requires a secondary opening in the lid that is separate from the straw or straw opening. In addition, when installing a press fit-type lid assembly, air must be able to escape to prevent the liquid in the container from traveling up the straw, which could cause a spill or leak. A secondary opening in the lid may help to address a vacuum from forming or liquid from traveling up the straw, but this secondary opening provides an additional leak path that needs to be addressed.

Figure 1:
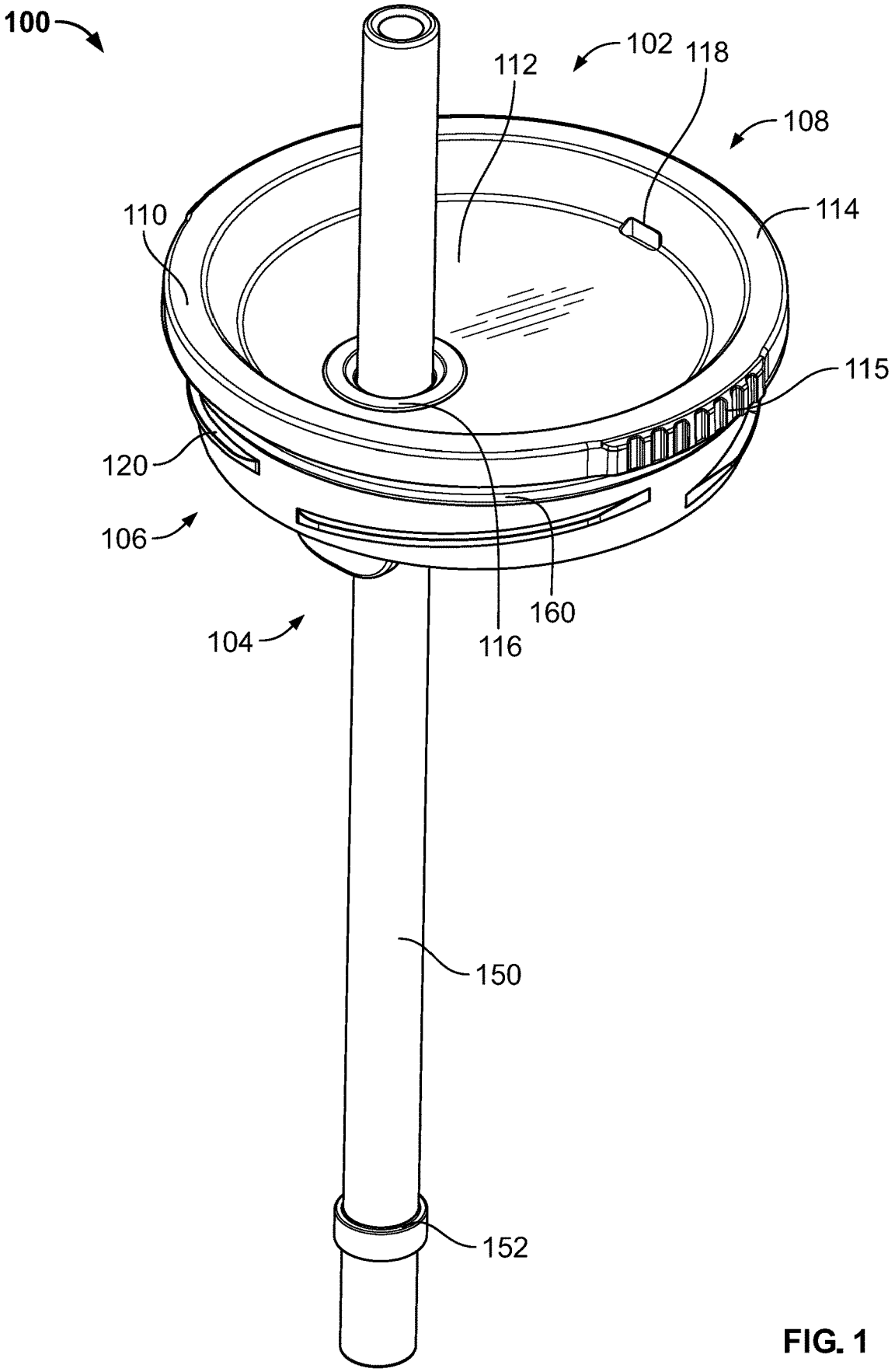
FIG. 1 illustrates a perspective view of a lid assembly that is configured to be removably coupled to a beverage container, according to one or more aspects described herein.
Figure 2:
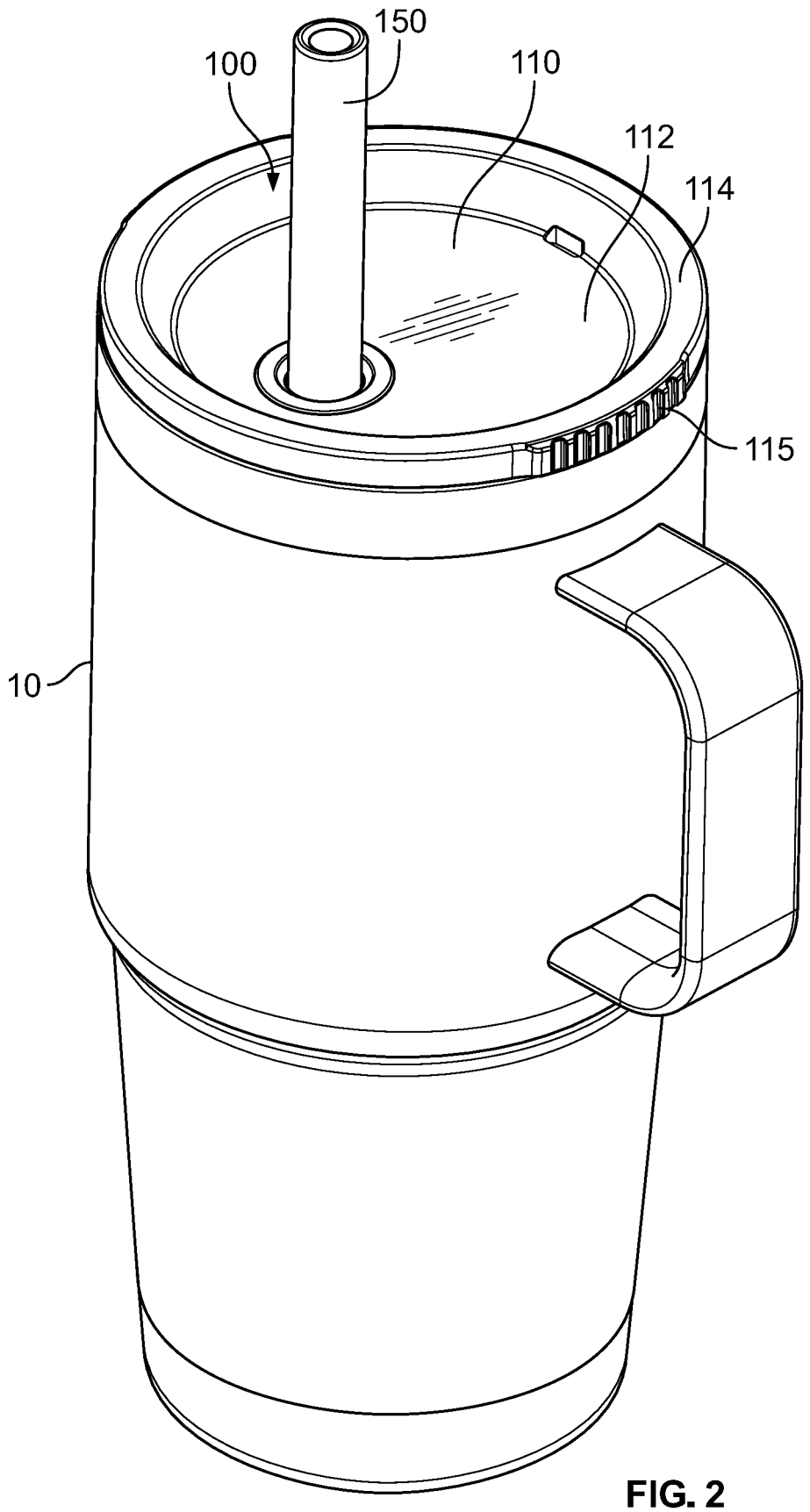
FIG. 2 illustrates a perspective view of the lid assembly of FIG. 1 attached to a beverage container, according to one or more aspects described herein.

FIG. 1 illustrates a lid assembly 100 for a beverage container that enables a user to drink from a straw 150 while allowing air to escape through a secondary opening 118 in a cover member 112 and also resisting potential leak paths for liquid to flow through the secondary opening 118. The lid assembly 100 may have a top 102, a bottom 104, a front 106, and a rear 108. FIG. 2 depicts a perspective view of lid assembly 100 removably coupled to a beverage container 10. Container 10 is one example container to which the lid assembly 100 is configured to be removably coupled. Accordingly, the container 10 may be configured to contain a volume of liquid and lid assembly 100 is configured to be releasably inserted into an opening of the container 10.

Figure 3:
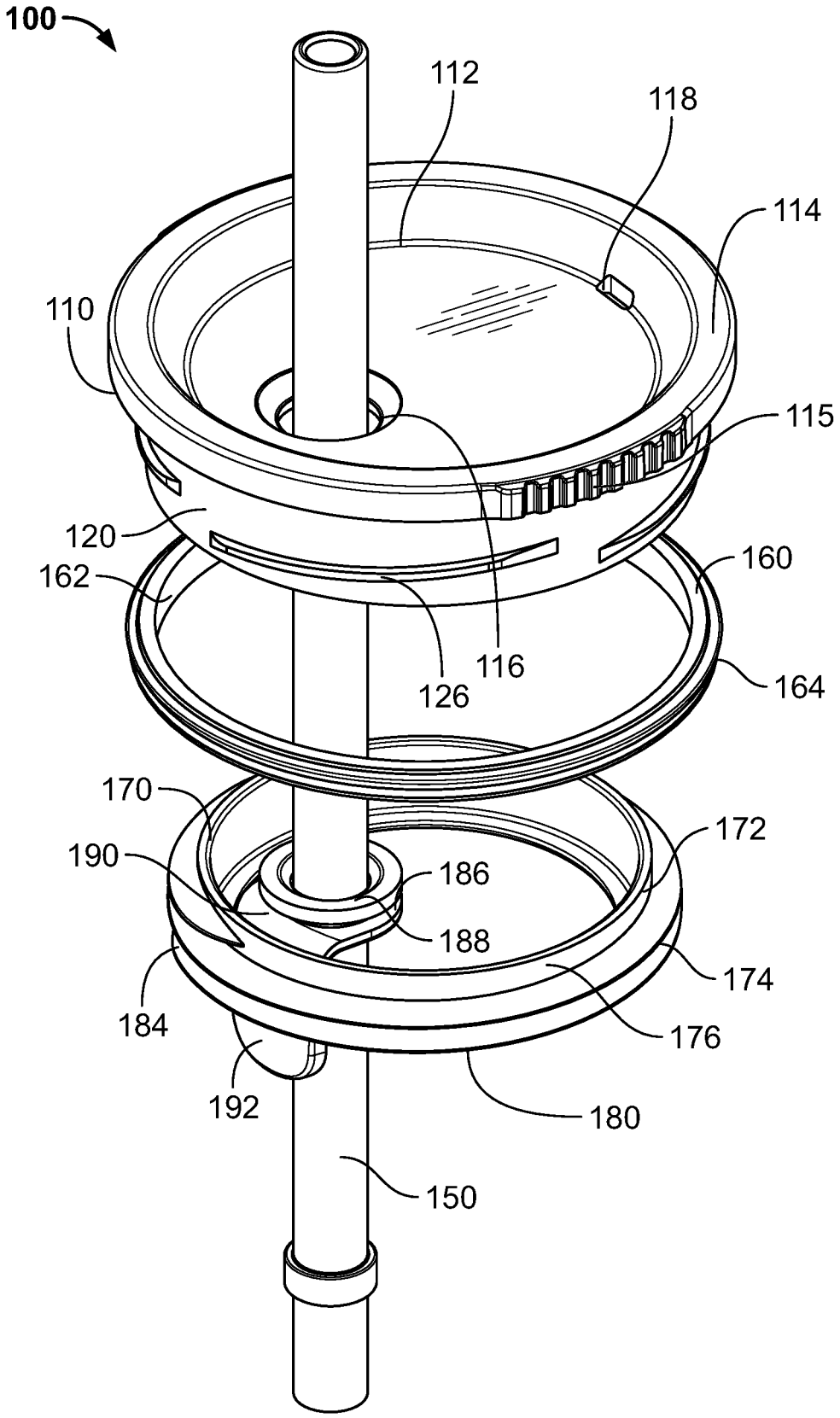
FIG. 3 illustrates an exploded perspective view of the lid assembly of FIG. 1, according to one or more aspects described herein.
Figure 4:
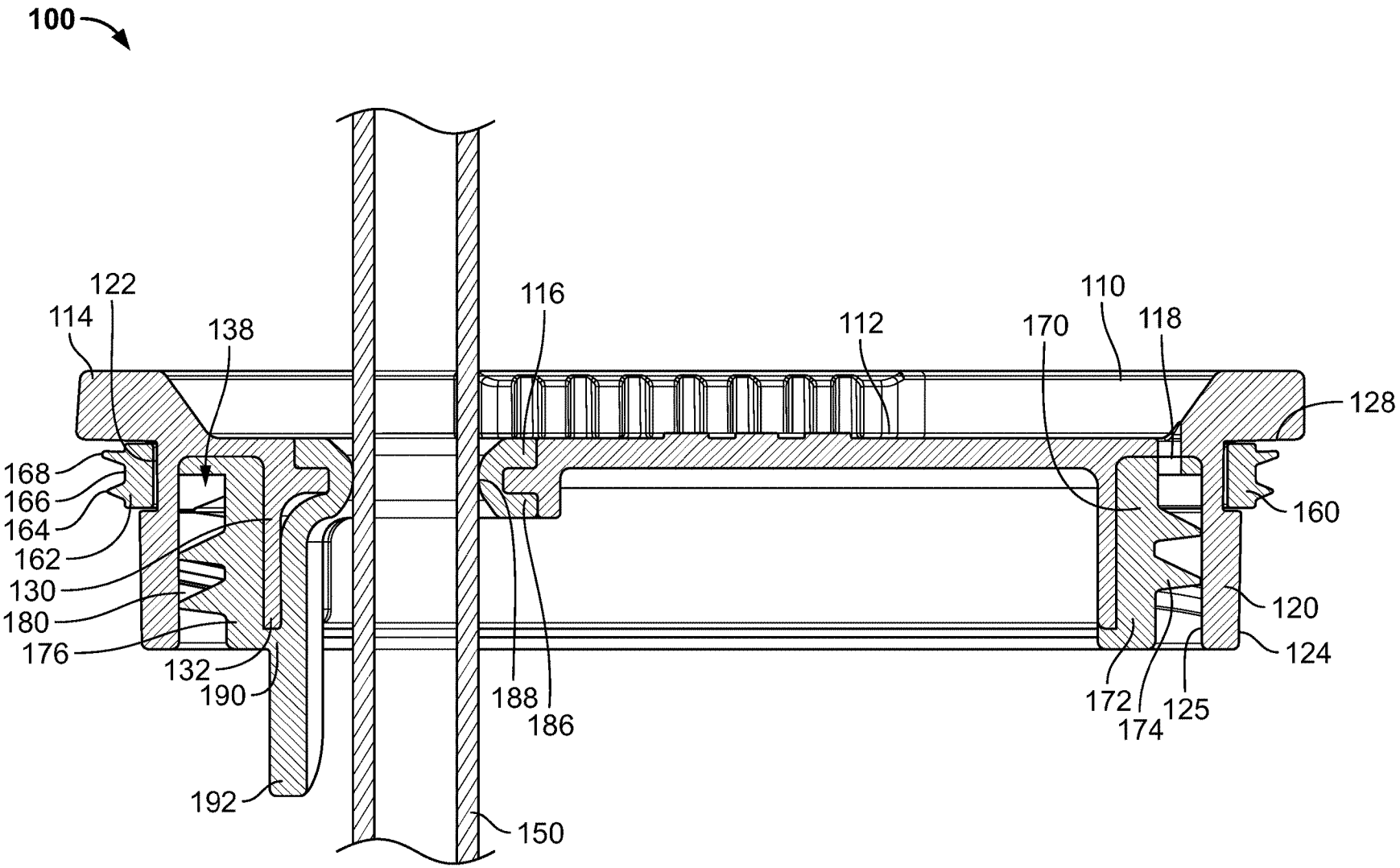
FIG. 4 illustrates a partial side cross-sectional view of the lid assembly of FIG. 1, according to one or more aspects described herein.

As shown in FIGS. 1, 3, and 4, the lid assembly 100 may comprise a base 110, a straw 150, a gasket 160 that extends around the base 110, and a grommet 170 connected to the base 110. The base 110 may include a cover member 112, a lip 114 extending upward from the cover member 112, a skirt member 120 extending downward from the cover member 112, a retaining wall 130 spaced inward from the skirt member 120 creating a grommet groove 138 between the skirt member 120 and the retaining wall 130, a primary opening 116 in the cover member 112, and a secondary opening 118 spaced from the primary opening 116 on the cover member 112. As shown in the illustrated examples, the grommet groove 138 may be open to the bottom 104 of the lid assembly 100, while in other examples, the grommet groove 138 may be open to the top 102 of the lid assembly 100. The straw 150 may extend through the primary opening 116 in the cover member 112. The primary opening 116 may be larger than the secondary opening 118. The primary opening 116 may receive the straw 150 and a portion of grommet 170 while the secondary opening 118 acts primarily as a vent to allow air to travel between outside environment and an interior of the container 10.

To form a seal between the base 110 and the container 10, gasket 160 may be arranged in a gasket groove 122 in the skirt member 120, where the gasket 160 includes a body member 162 and an annular ring 164 extending outward from an outer surface 166 of the body member 162. Annular ring 164 may be a projection that extends outward from the body member 162 around the perimeter of the body member 162 at same vertical location of the gasket 160. The gasket groove 122 may be located below a shelf 128 of the base 110 formed opposite a top surface of the lip 114 adjacent the outboard surface 124 of the skirt member 120. An outer edge 168 of the annular ring 164 may contact and compress against an inner surface of the container 10 to create an effective seal to prevent both liquid and air from escaping between the container 10 and the lid assembly 100 where the gasket 160 contacts the container 10. As shown in the illustrated examples, the gasket 160 may include a plurality of annular rings 164 to ensure no liquid or air escapes from this seal. Alternatively, the gasket 160 may not have annular rings and may only have a compressible main body member 162, such as an o-ring.

The grommet 170 may include a main body member 172, which may also be referred to as a primary body member, with a spiral ring 174 extending outward from an outer surface 176 of the main body member 172. The main body member 172 may be received in the grommet groove 138 of the base 110, where the grommet 170 is installed from the bottom 104 of the lid assembly 100 as shown in FIG. 4. Alternatively, in examples where the grommet groove 138 is open on the top 102, the grommet 170 may be installed from the top 102 of the lid assembly 100.

Figure 5:
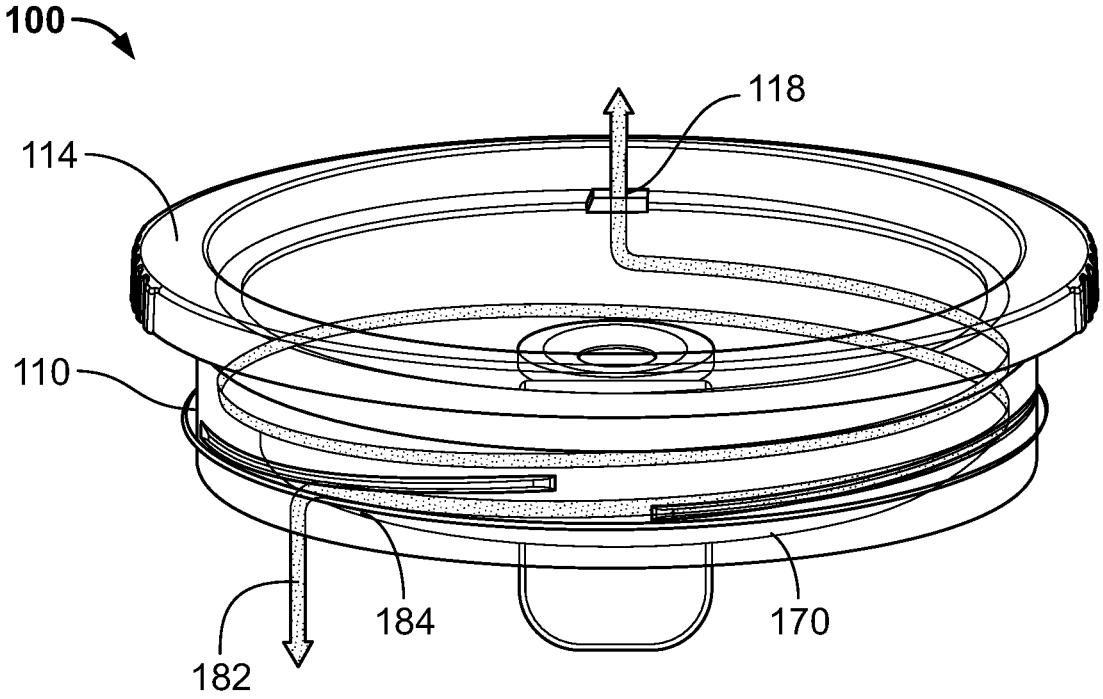
FIG. 5 illustrates a perspective view of an air path through a grommet of the lid assembly of FIG. 1, according to one or more aspects described herein.
Figure 6:
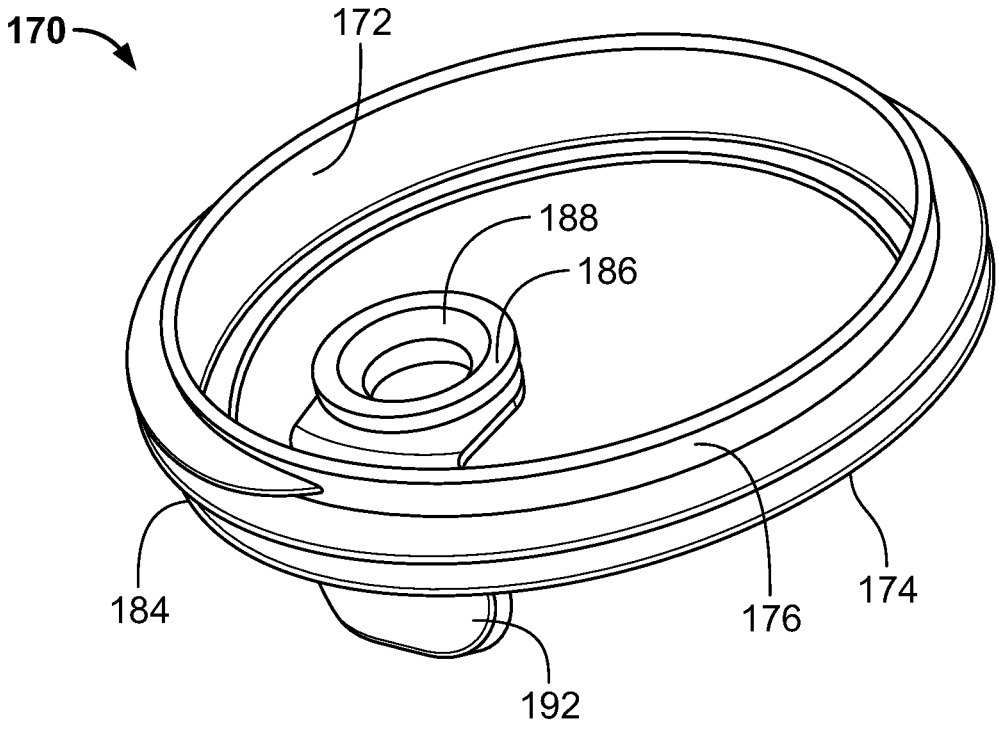
FIG. 6 illustrates a perspective view of a grommet of the lid assembly of FIG. 1, according to one or more aspects described herein.

The spiral ring 174 of the grommet 170 may comprise a tapered cross section and may extend around a portion of the outer surface 176. The spiral ring 174 may have a first end 184 on a lower portion of the main body member 172 and gradually moves upward along the main body member 172 as the spiral ring 174 moves around the main body member 172. The spiral ring 174 may be a continuous member that extends at least 180 degrees around the primary body member 172, or in other words, the spiral ring 174 makes at least one half of a revolution around the primary body member 172. In some examples, the spiral ring 174 may be a continuous member that extends at least 360 degrees around the primary body member 172, or in other words, the spiral ring 174 makes at least one revolution around the primary body member 172. In other examples, the spiral ring may extend at least 540 degrees around the primary body member 172, at least 720 degrees around the primary body member 172, or at least 900 degrees around the primary body member 172. An outboard edge 180 of the spiral ring 174 may contact and compress against an inboard surface 125 of the skirt member 120 creating a seal between the spiral ring 174 and an inboard surface 125 to form a spiraled flow path 182 in the lid assembly 100 as shown in FIG. 5. The flow path 182 begins at the first end 184 of the spiral ring 174 that is open to the interior of the container 10 and ends at the secondary opening 118 of the cover member 112. The flow path 182 allows air to travel freely in and out of the container 10. However, the spiraled airflow path 182 resists liquid from leaking through the secondary opening 118 by creating a torturous or difficult path for the liquid to follow to escape through the secondary opening 118. For example, for liquid to leak from a container 10 with lid assembly 100 having a grommet 170 with a spiral ring 174 that extends at least 540 degrees, the container 10 would need to be tilted at least 90 degrees and also rolled 1.5 times for the liquid to leak from the secondary opening 118. Thus, the grommet 170 helps to resist liquid leaks while providing an adequate flow path for air to move in and out of the container 10 through the lid assembly 100.

The grommet 170 may also help form a seal between the primary opening 116 and the straw 150. The grommet 170 may include a secondary body member 186 extending inward from the main body member 172 and a straw opening 188 in the secondary body member 186. The secondary body member 186 may be releasably secured within the primary opening 116, where the straw opening 188 is substantially aligned with the primary opening 116. The straw 150 may extend through the straw opening 188 where the secondary body member 186 compresses to form a seal between the straw 150 and the grommet 170 to prevent any liquid from leaking from the container 10 between the straw 150 and the grommet 170. The grommet 170 may also include a connecting member 190 that extends from the main body member 172 to the secondary body member 186. The connecting member 190 may extend around a lower end 132 of the retaining wall 130. As shown in the illustrated example, the grommet 170 may be a unitary member that includes both the main body member 172 and the secondary body member 186. Alternatively, the grommet 170 may be formed as separate members where a primary grommet provides the spiraled flow path 182 and a secondary grommet fits within the primary opening 116 to provide a seal between the straw 150 and the cover member 112. As another feature, the grommet 170 may include a pull-tab 192 that allows a user to easily grasp and remove the grommet 170 from the lid assembly 100 for periodic cleaning.

Referring back to FIGS. 1-3, the base 110 of the lid assembly 100 may have features to assist with the operation of the lid assembly 100. As discussed above, the base 110 includes a primary opening 116 to receive the secondary body member 186 of grommet 170 and the straw 150 while also having a secondary opening 118 to provide an air vent. As such, the primary opening 116 may be larger than the secondary opening 118. The openings 116, 118 may be aligned along a central plane and spaced apart of each other, where the primary opening 116 is nearer to a the front 106 of the lid assembly 100 and the secondary opening 118 is nearer the rear 108 of the lid assembly 100. In some examples, the primary opening 116 may be centrally located on the cover member 112. While the secondary opening 118 is shown on the cover member 112 of the base 110, the secondary opening 118 may be located anywhere on the may be base 110 where is it in fluid communication with airflow path 182. The secondary opening 118 may have a substantially rectangular shape as shown. In other examples, the secondary opening 118 may have a circular shape, an elliptical shape, or other geometric shape. The lip 114 may extend around a perimeter of the base 110 and may include a tapered surface that extends from a top surface of the lip 114 to the top surface of the cover member 112.

The base 110 of the lid assembly 100 may include features to assist in attachment to the container 10. For examples, lid assembly 100 may include external threads 126 arranged on an outboard surface 124 of the skirt member 120 to engage internal threads arranged on an interior surface of the container 10. The lip 114 may include ridges 115 arranged on opposite sides of the lip 114 to allow a user to easily grip and turn the lid assembly 100 to engage allow the external threads 126 to engage internal threads of the container 10. The shelf 128 may act as a stop for the lid assembly 100 when the shelf 128 contacts an upper surface of the container 10 when the lid assembly 100 is attached to the container 10.

The base 110, straw 150, gasket 160, and grommet 170 may each be formed using a molding process, such as injection molding. In some examples, the straw 150 may be extruded, where the stop 152 may be formed by overmolding it onto the extruded portion using injection molding. In addition, in some examples, the gasket 160 and grommet 170 may be compression molded. The base 110 and straw 150 may be molded from a clear or transparent polymer material, such as Tritan™ or other food safe polymer. In some examples, the retaining wall 130 may be formed of an opaque food-safe polymer material using a two-shot molding process. The two-shot molding process may help to improve aesthetics of the base 110 by providing different color options and to mask the appearance of the grommet 170. As another option, the gasket 160 and/or the grommet 170 may be overmolded onto the base 110. The gasket 160 and grommet 170 may be formed from a compressible elastomeric material, such as a silicone-based material, neoprene, nitrile, EPDM, or a rubber-based material. However, additional or alternative polymeric materials may be used, without departing from the scope of this disclosure.

Figure 7:
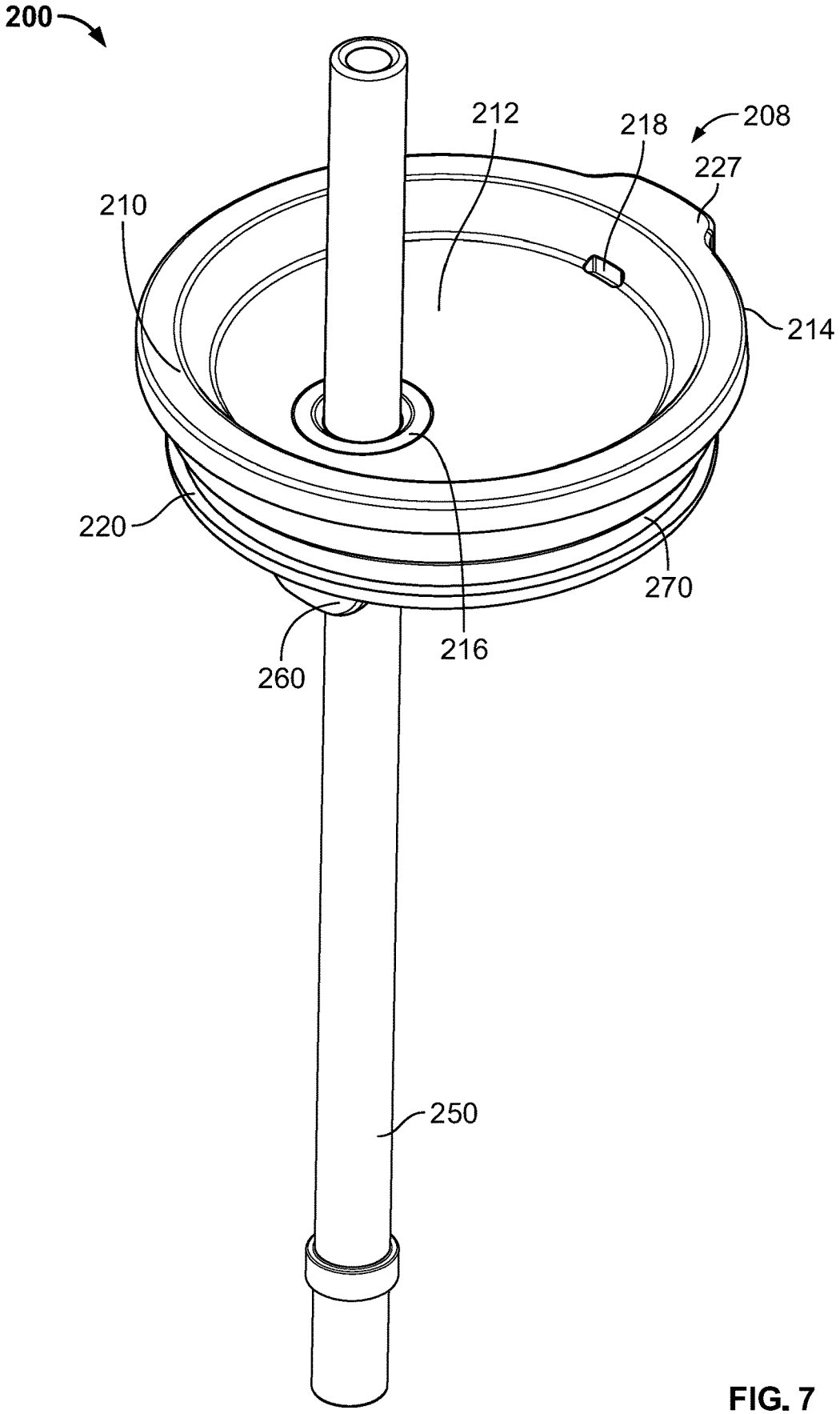
FIG. 7 illustrates a perspective view of an alternate lid assembly that is configured to be removably coupled to a beverage container, according to one or more aspects described herein.
Figure 8:
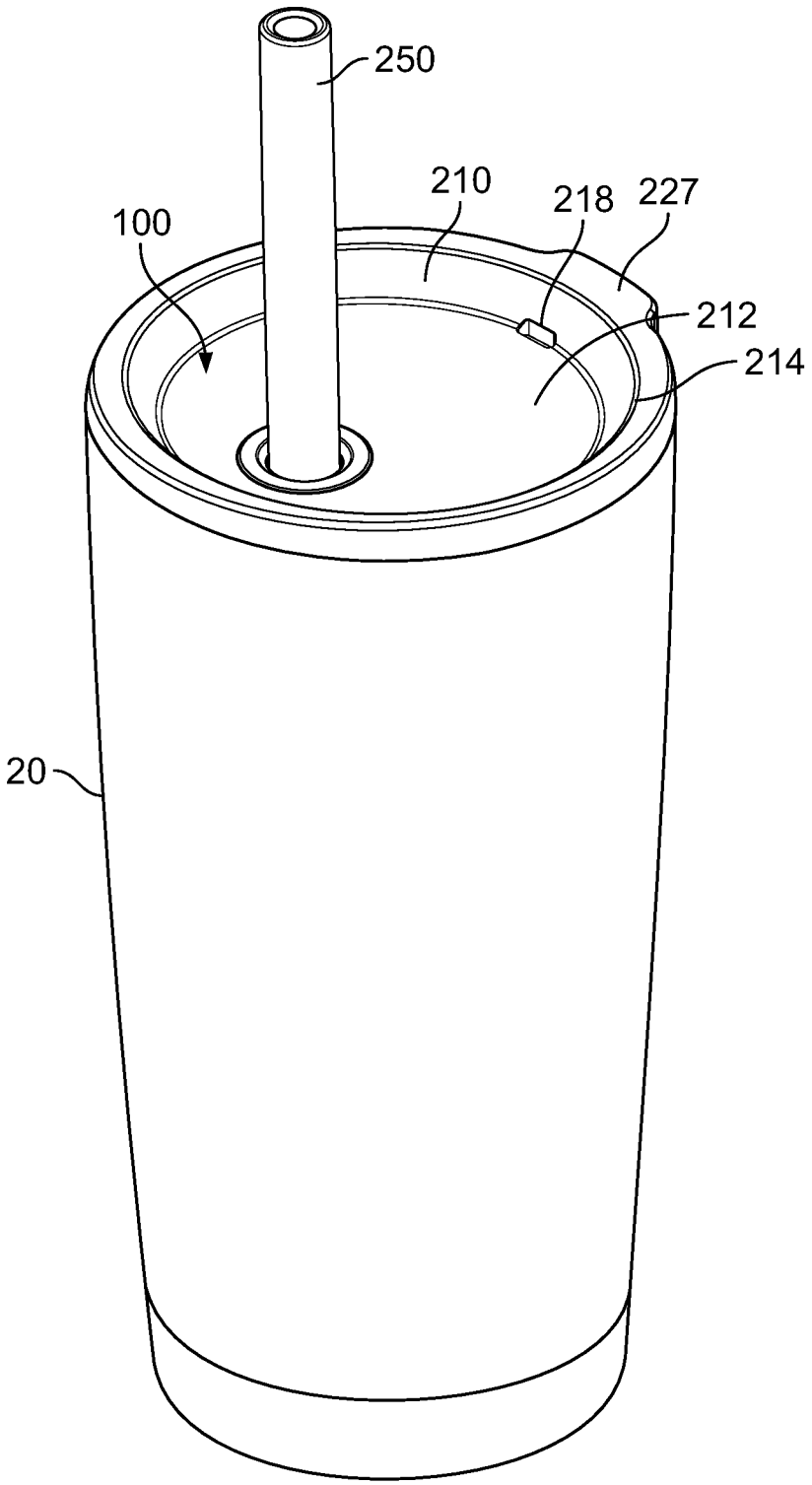
FIG. 8 illustrates a perspective view of the lid assembly of FIG. 7 attached to a beverage container, according to one or more aspects described herein.
Figure 9:
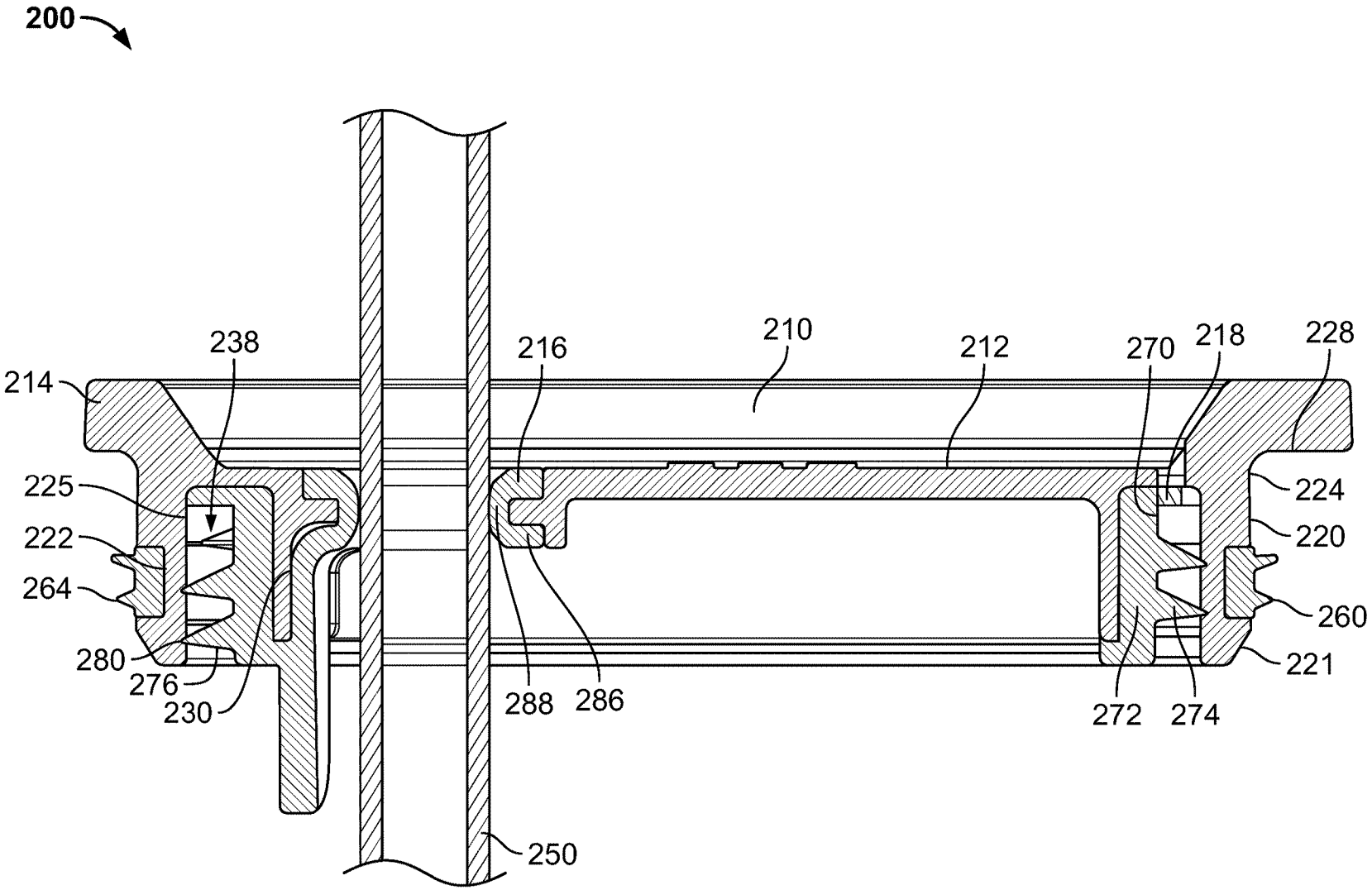
FIG. 9 illustrates a partial side cross-sectional view of the lid assembly of FIG. 7, according to one or more aspects described herein.

FIGS. 7-9 illustrate lid assembly 200. The features of lid assembly 200 are referred to using similar reference numerals under the "2xx" series of reference numerals, rather than "1xx" as used in the exemplary lid assembly 100 of FIGS. 1-6. Accordingly, certain features of lid assembly 200 that were already described above with respect to lid assembly 100 of FIGS. 1-6 may be described in lesser detail, or may not be described at all. Lid assembly 200 may be similar to lid assembly 100 except lid assembly 200 may have a press-fit connection to attach lid assembly 200 with container 20 instead of the threaded connection used to attach lid assembly 100 with container 10.

As shown in FIG. 7, lid assembly 200 may releasably couple to container 20. Lid assembly 200 may include a base 210, a straw 250, a gasket 260 that extends around a skirt member 220, and a grommet 270 connected to the base 210. The base 210 may include a cover member 212, a lip 214 extending upward from the cover member 212, a skirt member 220 extending downward from the cover member 212, a retaining wall 230 spaced inward from the skirt member 220 creating a grommet groove 238 between the skirt member 220 and the retaining wall 230, a primary opening 216 in the cover member 212, and a secondary opening 218 in the cover member 212. The straw 250 may extend through the primary opening in the cover member 212. The primary opening 216 may be larger than the secondary opening 218, where the primary opening 216 receives the straw 250 and a portion of grommet 270 and the secondary opening 218 acts primarily as a vent to allow air to travel between outside environment and an interior of the beverage container 20.

To facilitate a press fit engagement between the lid assembly 200 and the container 20, the base 210 of the lid assembly 200 may include features to assist in attachment to the container 20. For example, skirt member 220 may include a tapered end member 221 to help guide the base 210 into the container 20. In addition, the lip 214 may include a lid tab 227 that extends outward at the rear 208 of the lid assembly 200 to provide a user a location to easily grasp and remove or install the lid assembly 200. The shelf 228 may act as a stop for the lid assembly 200 when the shelf 228 contacts an upper surface of the container 20 when the lid assembly 200 is attached to the container 20.

Similar to lid assembly 100, the gasket 260, which may be similar to gasket 160, may help form a seal between the lid assembly 200 and the container 20 to prevent any liquid from leaking from the container 20. In addition, the contact between the annular rings 264 and interior of the container 20 may help to secure the lid assembly 200 to the container 20. In the illustrated example, the gasket 260 may be located in the gasket groove 222 where the gasket groove 222 is spaced away from the shelf 228. The gasket groove 222 may be located below a shelf 228 of the base 210 formed opposite a top surface of the lip 214 adjacent the outboard surface 224 of the skirt member 220.

The grommet 270 may be similar to grommet 170 of lid assembly 100. The grommet 270 may include a main body member 272, which may also be referred to as a primary body member, with a spiral ring 274 extending outward from an outer surface 276 of the main body member 272. The main body member 272 may be received in the grommet groove 238 of the base 210. An outboard edge 280 of the spiral ring 274 may contact and compress against an inboard surface 225 of the skirt member 220 creating a seal between the spiral ring 274 and an inboard surface 225 to form a spiraled flow path in the lid assembly 200. The grommet 270 may include a secondary body member 286 extending inward from the main body member 272, and a straw opening 288 in the secondary body member 286. The straw 250 may extend through the straw opening 288 where the secondary body member 286 compresses to form a seal between the straw 250 and the grommet 270 to prevent any liquid from leaking from the container 20 between the straw 250 and the grommet 270.

Figure 10:
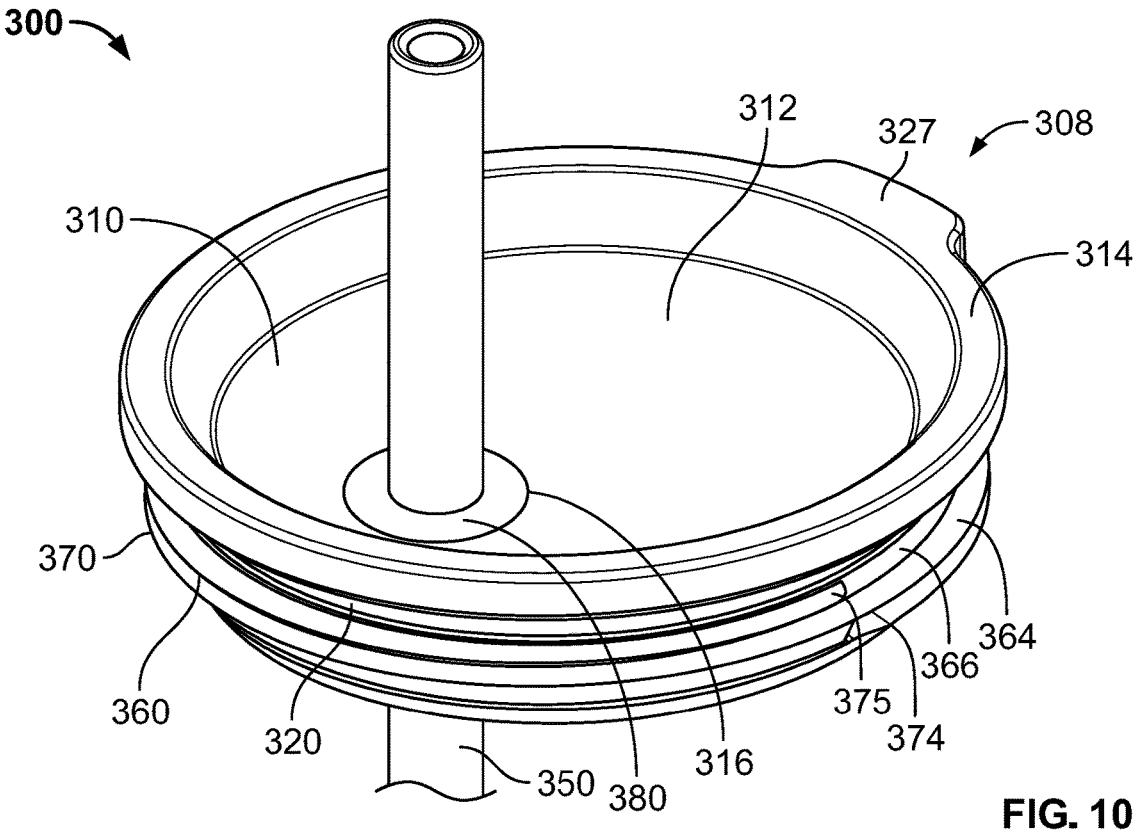
FIG. 10 illustrates a partial perspective view of an alternate lid assembly that is configured to be removably coupled to a beverage container, according to one or more aspects described herein.
Figure 11:
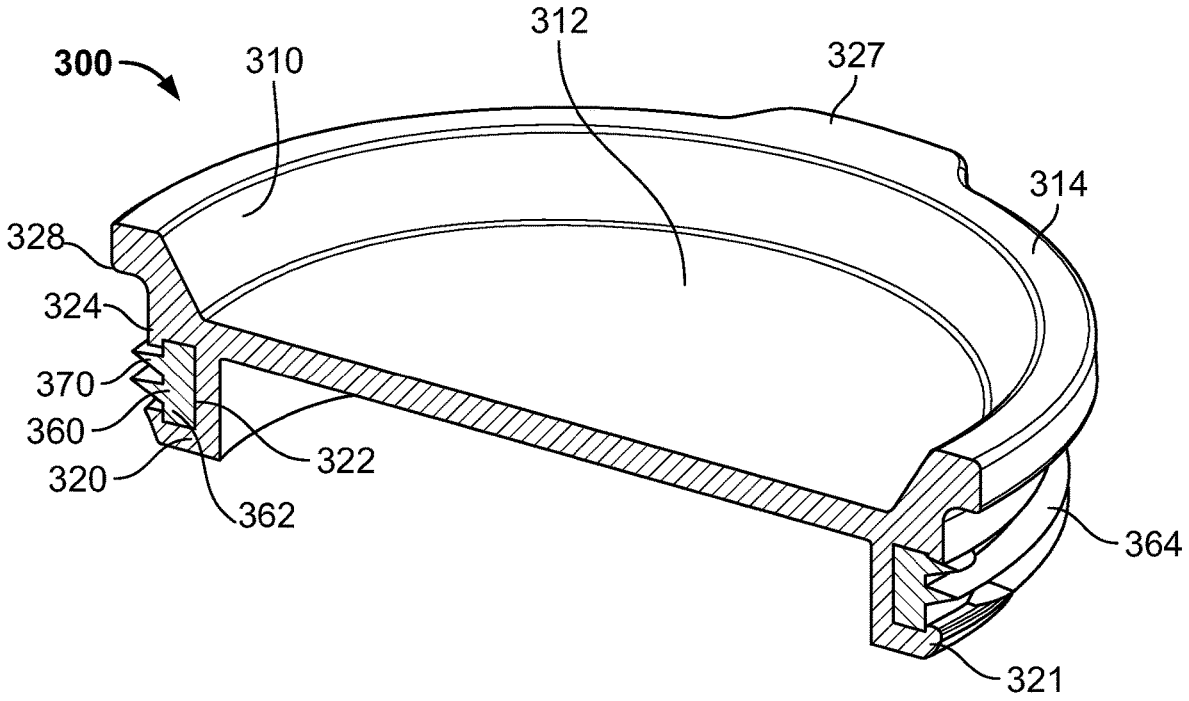
FIG. 11 illustrates a perspective cross-sectional view of the lid assembly of FIG. 10, according to one or more aspects described herein.

FIGS. 10-11 illustrate an alternate lid assembly 300 where the gasket provides the airflow path instead of the grommet as discussed with respect to lid assemblies 100 and 200. Lid assembly 300 is similarly configured as lid assembly 100 and 200 to include a base 310, a gasket 360 attached to the base 310, a straw 350 and a grommet 380 connected to the opening 316 of the base 310 to form a seal between the straw 350 and the base 310. Lid assembly 300 may releasably attach to a beverage container. The base 310 may include a cover member 312, a lip 314 extending upward from the cover member 312, a skirt member 320 extending downward from the cover member 312, and an opening 316 in the cover member 312. A straw 350 similar to straw 150 may extend through the opening 316 in the cover member 312. The opening 316 may receive a grommet 380 that has a straw opening, where the straw 350 extends through the straw opening of the grommet 380 to form a seal between the straw 350 and the grommet 380 to prevent liquids from leaking through the opening 316.

Figure 12:
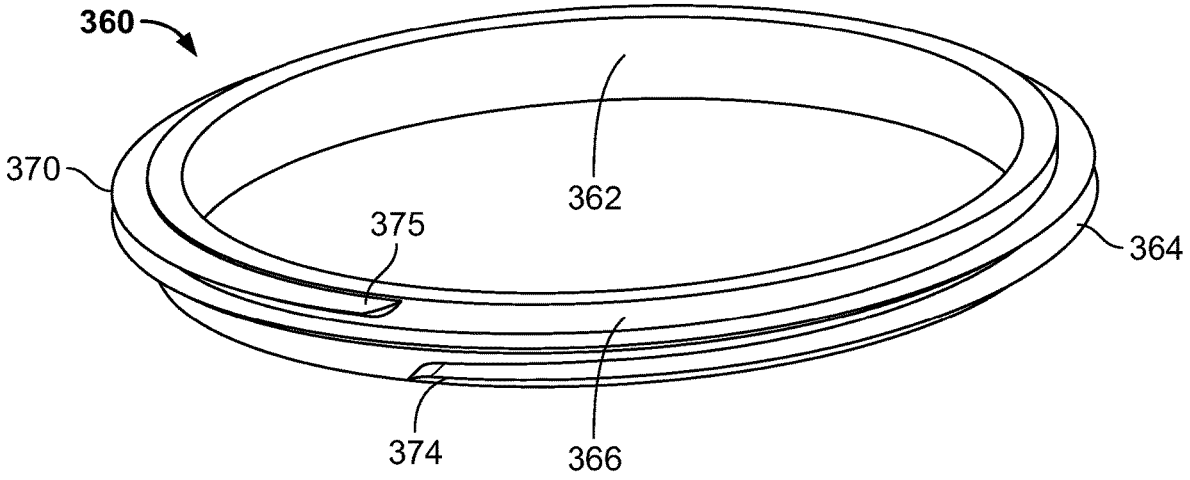
FIG. 12 illustrates a perspective view of a gasket of the lid assembly of FIG. 10, according to one or more aspects described herein.

The gasket 360 may provide an airflow path from an interior of the container to the exterior environment, while also resisting liquid from inside the container from leaking from the container. Gasket 360 may be arranged in a gasket groove 322 in the skirt member 320. As shown best in FIG. 12, the gasket 360 may include a main body member 362, which may also be referred to as a primary body member, with a spiral ring 364 extending outward from an outer surface 366 of the main body member 362. The main body member 362 may be received in the gasket groove 322 of the skirt member 320 as shown in FIGS. 10-11. The spiral ring 364 may have a tapered cross section and may extend around a portion of the outer surface 366. The spiral ring 364 has a first end 374 on a lower portion of the main body member 362 and gradually moves upward along the main body member 362 as the spiral ring 364 moves around the main body member 362. The spiral ring 364 may be a continuous member that extends at least 180 degrees around the primary body member 362, or in other words, the spiral ring 364 makes at least one half of a revolution around the primary body member 362. In some examples, the spiral ring 364 may be a continuous member that extends at least 360 degrees around the main body member 362, or in other words, the spiral ring 364 makes at least one revolution around the main body member 362. In some examples, the spiral ring 364 may extend at least 540 degrees around the main body member 362, at least 720 degrees around the main body member 362, or at least 900 degrees around the main body member 362. An outboard edge 370 of the spiral ring 364 may contact and compress against an interior surface of a container creating a seal between the spiral ring 364 and the interior surface of the container to form a spiraled airflow path in the lid assembly 300. The airflow path may begin at the first end 374 of the spiral ring 364 that is open to the interior of the container and end at an upper end 375 that is in fluid communication with exterior of the container. A gap or aperture may be formed between the skirt member 320 and the container near the upper end 375 of the spiral ring 364 to allow air to flow in and out of the container. As another option, the gap or aperture may be formed in the lip 314 or shelf 328 of the base 310 to allow air to escape from the interior of the container. The airflow path allows air to travel freely in and out of the container. However, the similar to the airflow paths 182 and 282 discussed above, spiraled flow path resists liquid from leaking directly through the gap and out of the container. For example, for liquid to leak from a container with lid assembly 300 that has a gasket 360 with a spiral ring 364 that extends at least 540 degrees, the container would need to be tilted at least 90 degrees and also rolled 1.5 times for the liquid to leak through the gap. Thus, the gasket 360 helps to resist liquid leaks while providing an adequate flow path for air to move in and out of the container through the lid assembly 300.

The grommet 380 may seal between the opening 316 and the straw 350. The grommet 380 may include a body member with a straw opening. The straw may extend through the straw opening where the body member compresses to form a seal between the straw 350 and the grommet 380 to prevent any liquid from leaking from the container between the straw and the grommet 380.

Referring back to FIGS. 10-11, the base 310 of the lid assembly 300 may have features to assist with the operation of the lid assembly 300. As discussed above, the base 310 includes an opening 316 to receive the grommet 380 and straw 350. The lip 314 may extend around a perimeter of the base 310 and may include a tapered surface that extends from a top surface of the lip 314 to the top surface of the cover member 312.

The base 310 of the lid assembly 300 may include features to assist in attachment to the container. The illustrated example of lid assembly 300 in FIGS. 10-11 has a base 310 to facilitate a press fit engagement between the lid assembly 300 and a container similar to base 210. For example, skirt member 320 may include a tapered end member 321 to help guide the base 310 into the container. In addition, the lip 314 may include a lid tab 327 that extends outward at the rear 308 of the lid assembly 300 to provide a user a location to easily grasp and remove or install the lid assembly 300. The shelf 328 may act as a stop for the lid assembly 300 when the shelf 328 contacts an upper surface of the container when the lid assembly 300 is attached to a container. Alternatively, lid assembly 300 may be configured to releasably connect to a container with a threaded connection similar to lid assembly 100. In these examples, lid assembly 300 may include external threads arranged on an outboard surface 324 of the skirt member 320 to engage internal threads arranged on an interior surface of a container. The lip 314 may include ridges arranged on opposite sides of the lip 314 to allow a user to easily grip and turn the lid assembly 300 to engage the external threads with the internal threads of the container.

Similar to the examples for lid assemblies 100 and 200, the base 310, straw 350, gasket 360, and grommet 380 may each be formed using a molding process, such as injection molding. The base 310 and straw may be molded from a clear or transparent polymer material, such as Tritan™ or other food safe polymer. The gasket 360 and grommet may be formed from a compressible elastomeric material, such as a silicone-based material. However, additional or alternative polymeric materials may be used, without departing from the scope of this disclosure.

Figure 13:
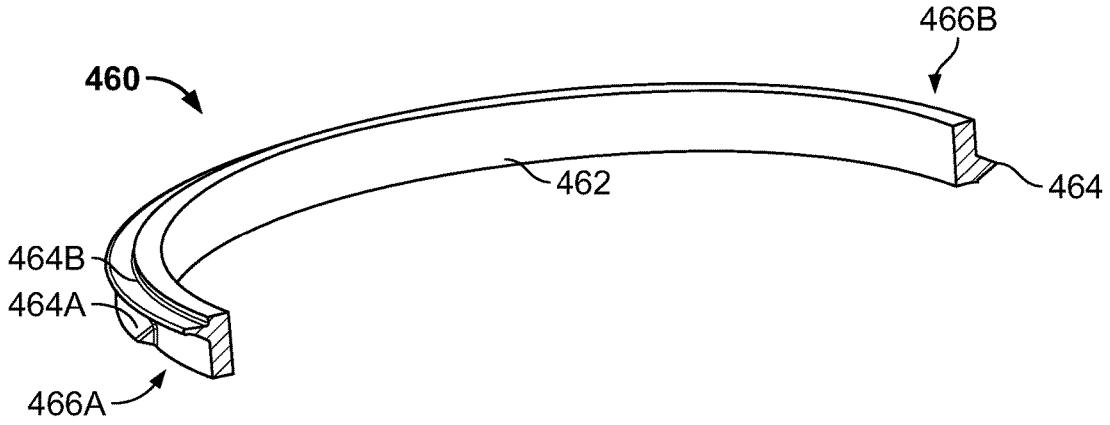
FIG. 13 illustrates a cross-sectional view of an alternate gasket of the lid assembly of FIG. according to one or more aspects described herein.

FIG. 13 illustrates another optional example of an alternate gasket 460 that can replace the gasket 360 of lid assembly 300. Gasket 460 includes a plurality of annular rings 464 that extend outward from the main body member 462, which may also be referred to as the primary body member. Each annular ring 464 may have a gap to create an airflow path that starts at a lower gap 466A in the lower annular ring 464A to allow air below the lid assembly 300 to flow through the lower gap 466A and above annular ring 464A. Air may then flow through upper gap 466B located in the upper annular ring 464B through the aperture or gap between the lid assembly 300 and the container to exit the container. Each gap may be staggered such that they are positioned at different locations around the perimeter of the annular rings 464. For example, lower gap 466A and upper gap 466B may be located approximately 180 degrees apart from one another. While the illustrated example of FIG. 13 shows only two annular rings 464, the number of annular rings 464 could be greater than two annular rings, such as three annular rings 464, four annular rings 464, or more. Each annular ring 464 will have a gap that is offset from the gap on the annular ring 464 either above or below it. These offset gaps 466A, 466B create a flow path that allows air to travel easily, but resists liquid from flowing directly out of the container through the gaps because of their staggered arrangement.

Figure 14:
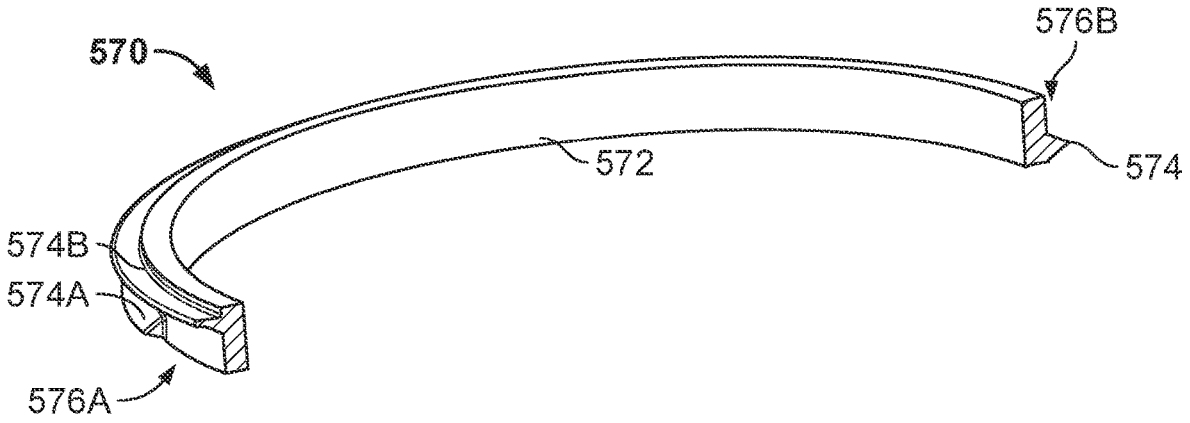
FIG. 14 illustrates a cross-sectional view of an alternate grommet of the lid assembly of FIG. 1 or FIG. 7, according to one or more aspects described herein.

FIG. 14 illustrates an alternate grommet 570 that can replace grommets 170, 270 of lid assemblies 100 and 200. Grommet 570 includes a plurality of annular rings 574 that extend outward from the main body member 572, which may also be referred to as the primary body member. Each annular ring 574 may have a gap to create an airflow path that starts at a lower gap 576A in the lower annular ring 574A to allow air below the lid assembly 100 or 200 to flow through the lower gap 576A and above annular ring 574A. Air may then flow through upper gap 576B located in the upper annular ring 574B through the secondary opening 118 or 218 to exit the container. Each gap may be staggered such that they are positioned at different locations around the perimeter of the annular rings 574. For example, lower gap 576A and upper gap 576B may be located approximately 180 degrees apart from one another. These offset gaps 576A, 576B create a flow path that allows air to travel easily, but resists liquid from flowing directly out of the container through the gaps because of their staggered arrangement. While the illustrated example of FIG. 14 shows only two annular rings 574, the number of annular rings 574 could be greater than two annular rings 574, such as three annular rings 574, four annular rings 574, or more. Each annular ring 574 will have a gap that is offset from the gap on the annular ring 574 either above or below it. Additionally, the illustrated grommet 570 in FIG. 14 is shown without the secondary body member 186 or 286, but grommet 570 may include the secondary body member 186 or 286 as described above.

The present disclosure is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

We claim:

1. A lid assembly for a beverage container, the lid assembly comprising:

a base including:

a cover member;

a lip extending upward from the cover member;

a skirt member extending downward from the cover member;

a first opening in the cover member;

a second opening in the cover member, wherein the second opening is spaced from the first opening; and a straw extending through the second opening; and a grommet connected to the base, wherein the grommet includes a primary body member and a spiral ring extending outward from an outer surface of the primary body member; and wherein the spiral ring creates an airflow path from below the lid assembly to the first opening.

2. The lid assembly of claim 1, wherein the base further includes a retaining wall spaced inward from the skirt member creating a grommet groove between the skirt member and the retaining wall.

3. The lid assembly of claim 1, wherein the spiral ring contacts an inboard surface of the skirt member.

4. The lid assembly of claim 1, further comprising:

a gasket arranged in a gasket groove in the skirt member, wherein the gasket includes a body member and an annular ring extending outward from an outer surface of the body member, and wherein the annular ring contacts an inner surface of the beverage container.

5. The lid assembly of claim 1, wherein the grommet further comprises a secondary body member extending inward from the primary body member, and a straw opening in the secondary body member; and wherein the straw extends through both the second opening and the straw opening.

6. The lid assembly of claim 1, wherein the spiral ring extends at least 180 degrees around a perimeter of the primary body member.

7. The lid assembly of claim 2, wherein the grommet is received in the grommet groove.

8. The lid assembly of claim 2, wherein the grommet groove is open to below the lid assembly.

9. The lid assembly of claim 5, wherein the base further includes a retaining wall spaced inward from the skirt member creating a grommet groove between the skirt member and the retaining wall, wherein the grommet groove receives the grommet; and wherein the grommet further comprises a connecting member that extends from the primary body member to the secondary body member; and wherein the connecting member extends around a lower end of the retaining wall.

10. The lid assembly of claim 9, wherein the grommet is formed as a unitary member.

11. A lid assembly for a beverage container, the lid assembly comprising:

a base including:

a cover member;

an opening in the cover member;

a lip extending upward from the cover member; and a skirt member extending downward from the cover member;

a straw extending through the opening; and a gasket arranged in a gasket groove in the skirt member, the gasket including a body member and a spiral ring extending outward from an outer surface of the body member; and wherein the spiral ring creates an airflow path from below the lid assembly to an exterior of the lid assembly through an aperture formed between the skirt member and the beverage container.

12. The lid assembly of claim 11, further comprising a grommet arranged in the opening of the cover member, wherein the grommet includes a straw opening that receives the straw.

13. The lid assembly of claim 11, wherein an outboard edge of the spiral ring is configured to contact an interior surface of the beverage container.

14. The lid assembly of claim 11, wherein the spiral ring extends at least 180 degrees around a perimeter of the body member.

15. The lid assembly of claim 11, wherein the spiral ring extends at least 540 degrees around a perimeter of the body member.

16. A lid assembly for a beverage container, the lid assembly comprising:

a base including:

a cover member;

a lip extending upward from the cover member; the lip positioned around a perimeter of the cover member;

a skirt member extending downward from the cover member;

a first opening in the cover member;

a second opening in the cover member, wherein the second opening is spaced from the first opening; and a straw extending through the second opening; and a grommet connected to the base, the grommet including a primary body member and a plurality of annular rings extending outward from an outer surface of the primary body member; and wherein each annular ring of the plurality of annular rings has a gap, wherein the plurality of annular rings create an airflow path from below the lid assembly to the first opening.

17. The lid assembly of claim 16, wherein a first gap on a first annular ring is located at a different location on a first perimeter of the first annular ring than a second gap located on a second perimeter of a second annular ring.

* * * * *